United States Patent [19]

Arnswald

[11] 4,333,685

[45] Jun. 8, 1982

[54] ROAD SURFACING APPARATUS

[75] Inventor: Jeffrey K. Arnswald, Olathe, Kans.

[73] Assignee: Federal-Mogul Corporation, Detroit, Mich.

[21] Appl. No.: 157,945

[22] Filed: Jun. 9, 1980

[51] Int. Cl.[3] ..... E01C 23/09

[52] U.S. Cl. ..... 299/39; 51/176

[58] Field of Search ..... 299/39, 41; 51/176

[56] References Cited

U.S. PATENT DOCUMENTS

| | | | |
|---|---|---|---|
| 3,201,173 | 4/1965 | Hatcher | 299/39 |
| 3,208,796 | 9/1965 | Hatcher | 299/39 |
| 3,269,775 | 8/1966 | Hatcher | 299/39 |
| 3,272,560 | 9/1966 | Hatcher | 299/39 |
| 3,407,005 | 10/1968 | Simms et al. | 299/39 |
| 3,409,330 | 11/1968 | Hatcher et al. | 299/39 |
| 3,414,327 | 12/1968 | Austin | 299/39 X |
| 3,464,737 | 9/1969 | Haase et al. | 299/39 |
| 3,547,492 | 12/1970 | Binger | 299/39 |
| 3,606,467 | 9/1971 | Christensen et al. | 299/39 |
| 3,606,469 | 9/1971 | Hughes | 299/39 |
| 3,608,969 | 9/1971 | Fowkes | 51/176 X |
| 3,697,135 | 10/1972 | Hatcher et al. | 299/39 |
| 3,703,316 | 11/1972 | Hatcher et al. | 299/39 |
| 3,724,900 | 4/1973 | Hatcher et al. | 299/39 |
| 3,765,724 | 10/1973 | Hatcher et al. | 299/39 |
| 3,779,607 | 12/1973 | Staab | 299/39 |
| 3,829,161 | 8/1974 | Wirtgen | 299/39 |
| 3,888,542 | 6/1975 | Gowler | 299/39 X |
| 3,971,594 | 7/1976 | Wirtgen | 299/39 |
| 3,975,055 | 8/1976 | Wirtgen | 299/39 |
| 3,989,304 | 11/1976 | Wirtgen | 299/39 |

*Primary Examiner*—Ernest R. Purser

*Attorney, Agent, or Firm*—William G. Coon

[57] ABSTRACT

A road surfacing machine for removing bumps from a roadway. A sub-frame supporting a cutter head is pivotally attached to a main frame and is controllably urged downwardly into cutter head operable position. Walking beams supporting depth control wheels which ride in the surfacing cut are pivotally attached to the sub-frame. Outrigger depth control wheels are provided near the ends of the cutter head for feathering successive cuts.

18 Claims, 13 Drawing Figures

ROAD SURFACING APPARATUS

BACKGROUND OF THE INVENTION

This invention relates to road surfacing machines in general and in particular to those machines capable of planing a road surface to a level of desired flatness.

Roadways and runways are generally built to construction specifications which define the maximum amount of vertical deviation from a reference plane over a given longitudinal distance, for example, 7 inches of vertical deviation over a mile of length. If, after the roadway or runway is built, the deviation is found to be greater than the maximum allowed, the higher portions must be ground down or planed to bring the construction to within specifications. Considering the small amount of deviation required, it is obvious that close control of the cut made by a road planing machine is necessary.

Major deficiencies in prior art road planing devices include the lack of such control and the related inability to keep the cutter head penetrating to the desired depth for proper surface finish. This often occurs when the machine is not capable of transferring enough controlled weight to the cutter head while maintaining the desired longitudinal (forward) speed. Another deficiency in prior art devices is the inability to accurately and reliably blend or "feather" cuts into each other using the adjacent prior cut as a reference.

OBJECTS OF THE INVENTION

The principal objects of the present invention are: to provide a road planing machine capable of producing accurately controlled cut depth; to provide a road surfacing machine having a cutter head mounted on a sub-frame which is pivotally connected to a main frame to more accurately control the operation thereof; to provide such a machine which utilizes depth control wheels mounted on walking beams which are pivotally connected to the sub-frame behind the cutter head to provide increased cutting accuracy; to provide a road planing machine which is better adapted to controllably transfer the weight of the machine to the cutter head for snubbing the cutter head onto the surface being abraded; to provide a cutting device of simple design which is more capable of using a prior cut as a reference for accurately controlling cut depth while making a new cut; to provide such a device which utilizes auxilliary outrigger wheels adapted to ride in the previous cut to more accurately provide a reference; and to provide such a road planing machine which is easily manufactured, capable of an extended useful life, and particularly well adapted for the proposed use thereof.

Other objects and advantages of this invention will become apparent from the following description taken in connection with the accompanying drawings wherein are set forth, by way of illustration and example, certain embodiments of this invention.

SUMMARY OF THE INVENTION

This invention involves a road planing machine having a main frame with generally parallel spaced apart longitudinal side frame members including a raised medial portion. A sub-frame is pivotally connected near a front portion thereof to the main frame about a laterally central pivot point such as to be positioned within the main frame side members partially adjacent the raised portion of the main frame. Two vertical, laterally spaced hydraulic cylinders are positioned between the raised portion of the main frame and the sub-frame and function to transfer main frame weight and pivot the sub-frame about the central pivot point relative to the main frame. A transversely positioned cutter head is mounted on a rear portion of the sub-frame and an engine, which rotationally drives the cutter head and the supporting wheels of the machine, is positioned forwardly of the cutter head on the sub-frame. Adjustable pivot beams supporting tandem pairs of balanced depth control wheels are pivotally attached at a one end thereof to opposed sides of the sub-frame behind the cutter head. Jack screws positioned between a free end of the pivot beams and the sub-frame function to adjust the walking beams about their point of attachment on the sub-frame and thereby vary the vertical position of the depth control wheels relative to the sub-frame. Outrigger wheels are also attached to the sub-frame, but ahead of the cutter head and laterally outwardly therefrom. The outrigger wheels are selectively vertically displaceable with respect to the sub-frame.

The drawings constitute a part of this specification, include an exemplary embodiment of the present invention and illustrate various objects and features thereof.

BRIEF DESCRIPTION OF THE DRAWINGS

FIG. 1*b* is a partial side elevational view of the front portion thereof.

DETAILED DESCRIPTION OF THE PREFERRED EMBODIMENT

Figure 1A:
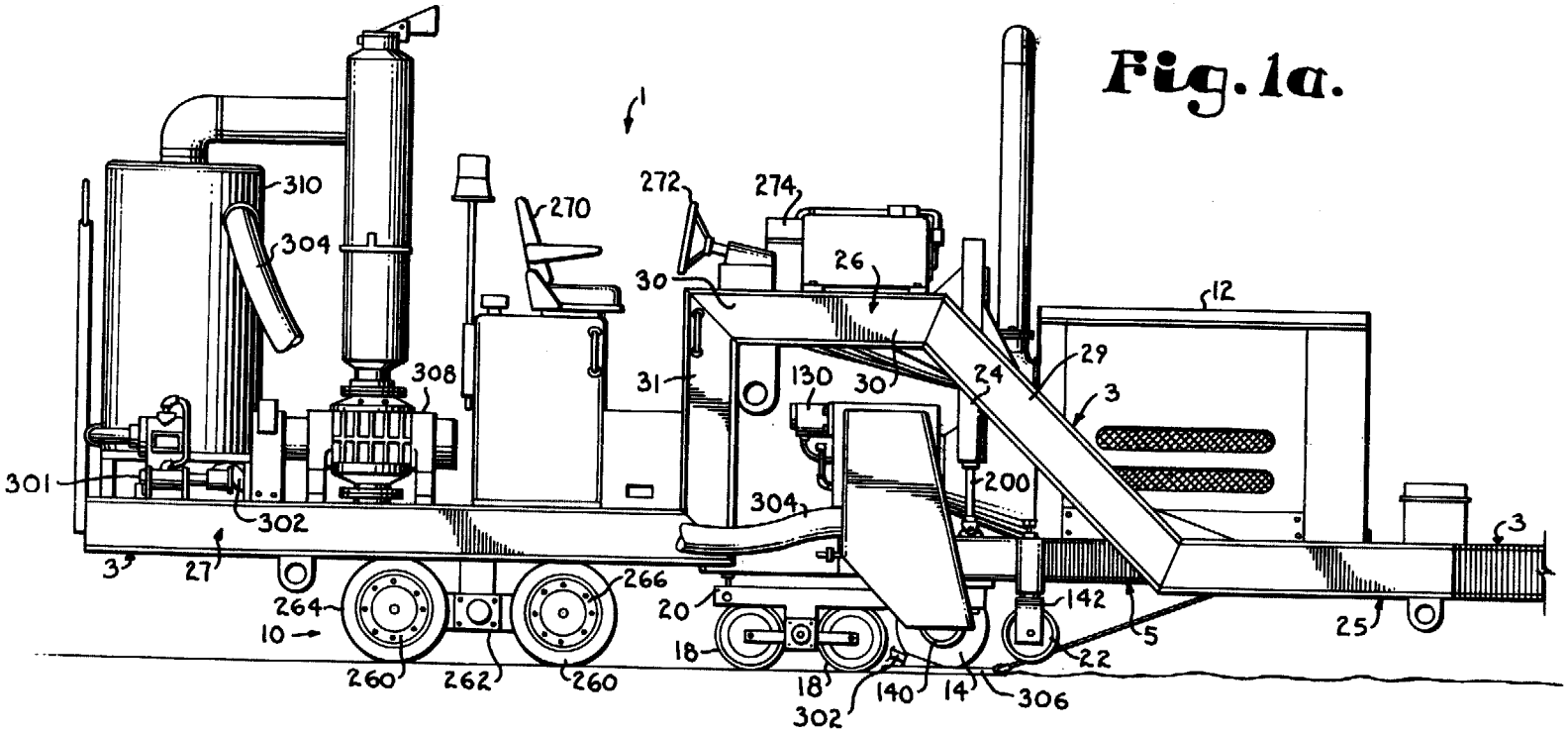
FIG. 1*a* is a partial side elevational view of a road planing machine embodying this invention.
Figure 3:
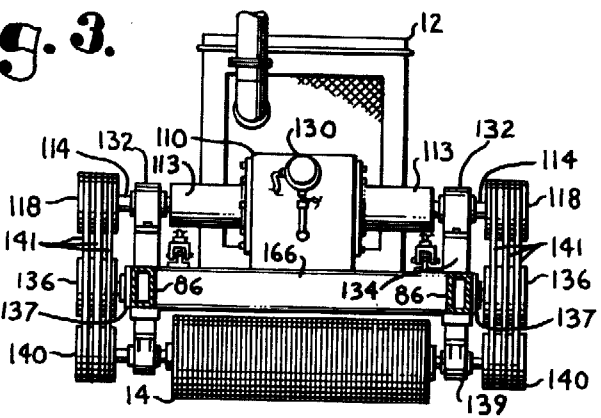
FIG. 3 is an elevational view of the cutter drive unit taken on line 3—3 of FIG. 2.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a roadway surfacing machine or planer embodying this invention. The planer 1 comprises a rigid main frame 3 and a rigid sub-frame 5 which is pivotally attached to the main frame. Front wheel means, generally designated by reference numeral 8, are situated near a front portion of main frame 3. Rear wheel means, generally designated 10, are positioned near a rear portion of the main frame. A suitable prime mover such as a heavy industrial engine 12, is mounted on the sub-frame 5 and drives a cutter head 14 which is transversely mounted on the sub-frame 5 rearwardly of the engine 12. Depth of cut control means such as depth control wheels 18 are mounted on adjustable pivot beams 20 which are pivotally connected at a front portion thereof to the sub-frame 5. Auxiliary outrigger depth of cut control means such as outrigger wheels 22 are provided on the sub-frame 5. Ram means which function as weight transfer means, in this example vertical cylinders 24, are operably positioned between the main frame 3 and the sub-frame 5. An auxiliary engine (not shown) is mounted on the main frame along with associated devices to provide water to cool the cutter head and dispose of grit produced by the planer.

Referring particularly to FIG. 1*a*, the main frame 3 has a front portion 25, a raised medial portion 26 and a rear portion 27. The main frame 3 is comprised of two generally parallel longitudinal side members 28 including the raised medial portion 26 which, in turn, includes an inclined section 29, a horizontal elevated section 30 and a vertical depending section 31.

A cross-member 32 is transversely mounted in the front portion 25 and extends between the side members 28. Two ears 34 are attached to a plate 35 which in turn is secured to a rear vertical surface 37 of cross-member 32. The ears 34 extend in spaced apart parallel fashion rearwardly from plate 35 and have therein coaligned pivot pin receiving apertures 39.

Figure 4:
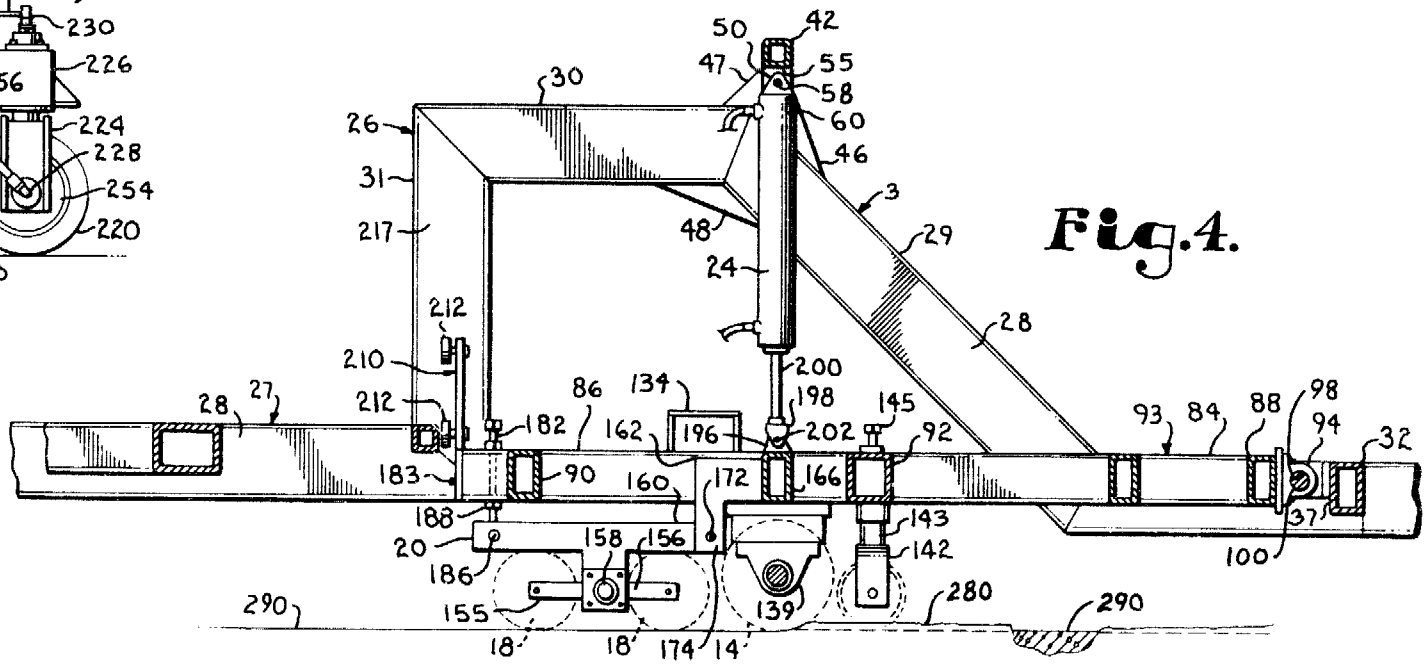
FIG. 4 is an enlarged fragmentary side elevational view of the sub-frame and main frame medial portion with portions removed to show detail.
Figure 11B:
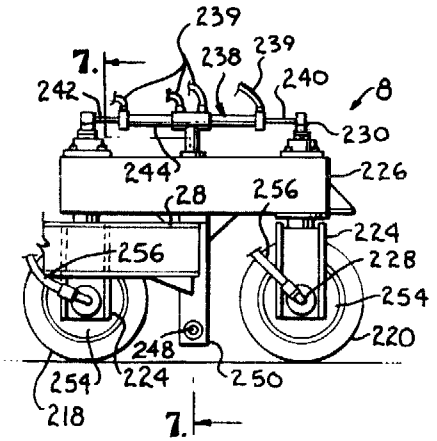
FIG. 11 is a modified schematic view showing the relationship between the sub-frame and a road surface.
Figures 6, 7:
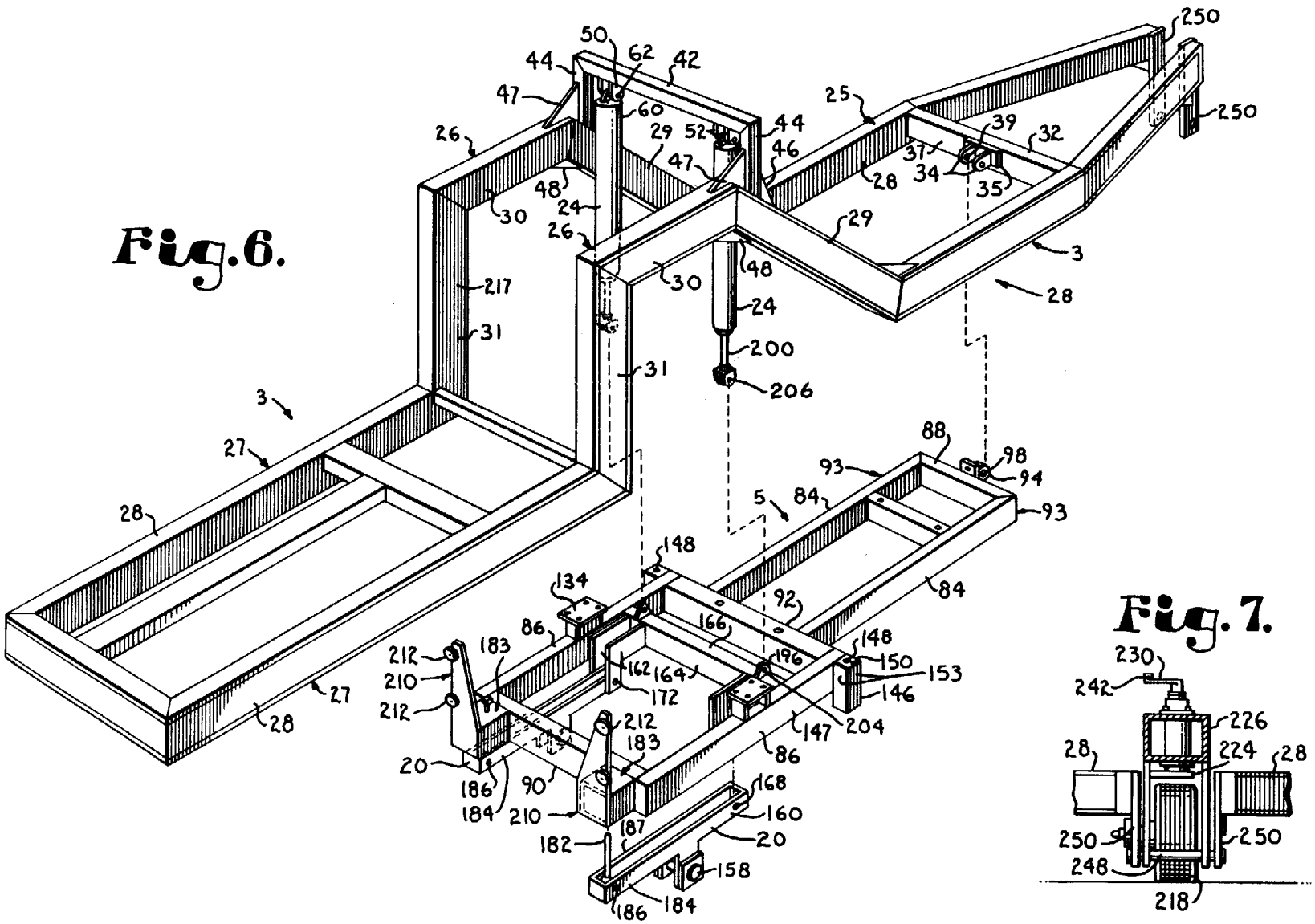
FIG. 6 is an exploded perspective view showing the main frame and sub-frame.
FIG. 7 is a partial cross-sectional view of the road planer taken on line 7—7 of FIG. 1*b*.
Figure 8:
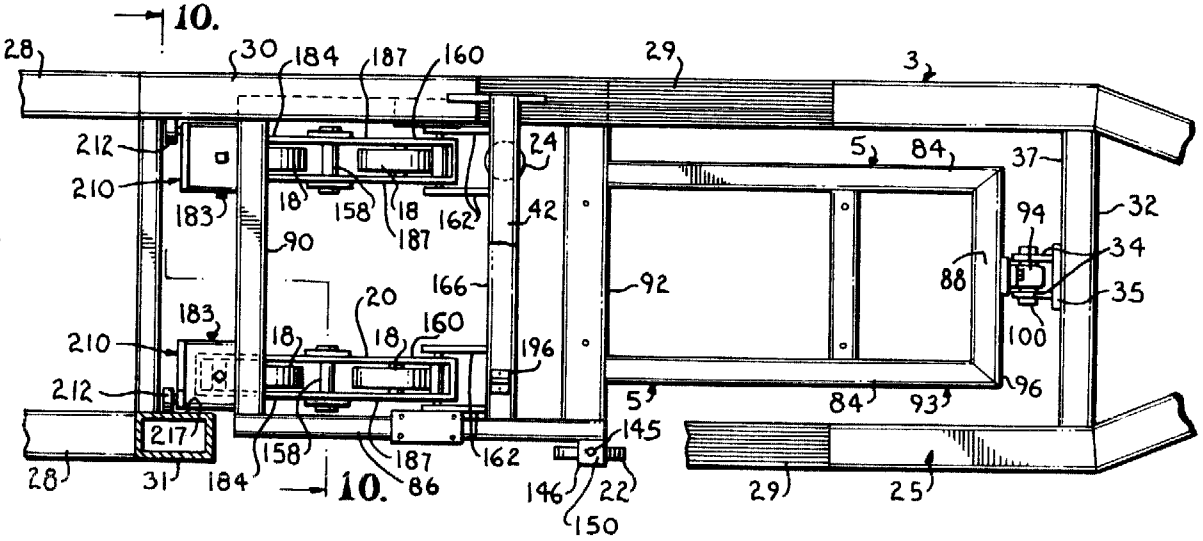
FIG. 8 is a partial top plan view of the assembled main frame and sub-frame with portions broken away to show details thereof.
Figure 10:
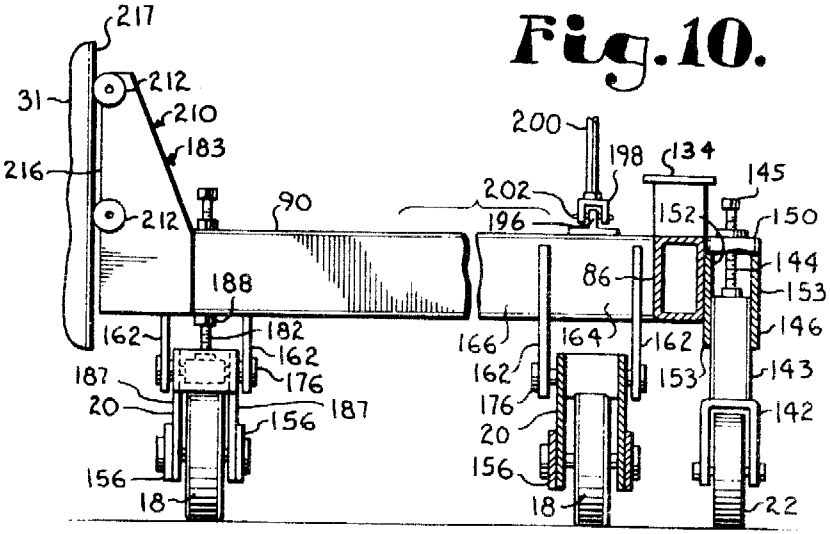
FIG. 10 is a rear elevational view of the sub-frame with portions broken away to show details thereof.
Figure 9:
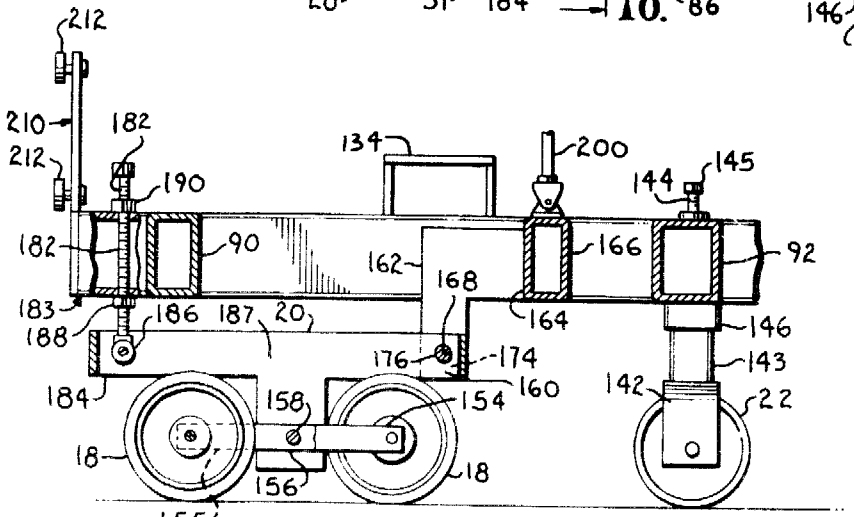
FIG. 9 is a partial cross-sectional view of a rear portion of the sub-frame with portions broken away to show details thereof.

A cross brace 42 is transversely secured between main frame side members 28 and projects upwardly from the medial portion 26. The brace 42 is mounted on brace mounting members 44 which extend vertically from respective frame side members 28. Gussets 46 (FIG. 4) and 47 (FIG. 6) are placed for added strength adjacent the brace mounting members 44 and respective side members 28. Likewise strengthening gussets 48 are positioned between the inclined section and horizontal section of the raised medial portion 26. Laterally spaced pairs of ears 50 and 52 extend downwardly in parallel fashion from a bottom surface 55 of mounting brace 42 and contain therein transversely coaxially aligned apertures 58. First ends 60 of vertical cylinders 24 are received between respective ear pairs 50 and 52 and pivotally retained therein by pins 62 or the like.

The sub-frame 5 comprises forward and rear side frame members 84 and 86 respectively, front and rear transverse frame members 88 and 90 respectively, and an intermediary transverse frame member 92.

The sub-frame 5 is pivotally connected near a front portion 93 thereof to the main frame 3. A bearing block 94, is attached to a front vertical surface 96 of front transverse frame member 88, and is received between ears 34 such that an aperture 98 in bearing block 94 is coaxially aligned with apertures 39. A pivot pin 100 is received in apertures 39 and 98, securely attaching the sub-frame 5 to the main frame while allowing the sub-frame 5 to pivot relative to the main frame and about the centrally positioned pin 100.

Figure 2:
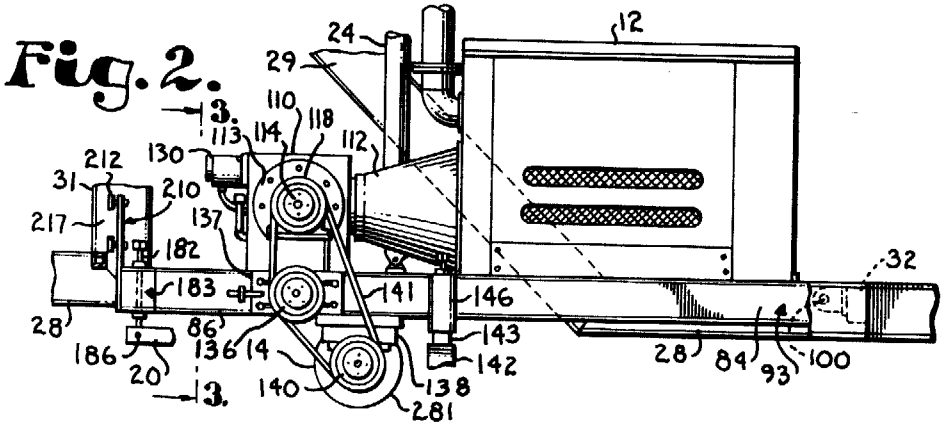
FIG. 2 is a partial side elevational view of a sub-frame thereof with portions broken away to show detail.
Figure 5:
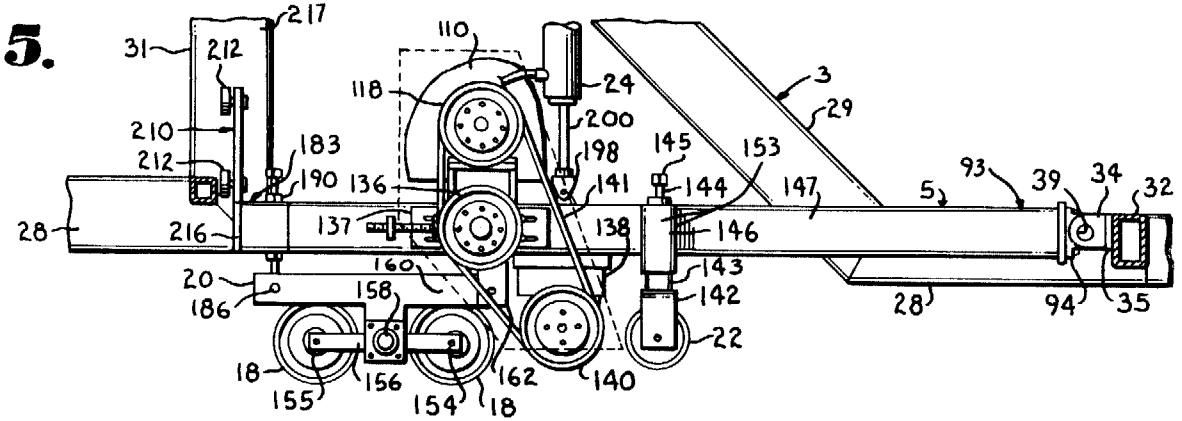
FIG. 5 is a side elevational view similar to FIG. 4 but showing the exterior of the sub-frame with portions broken away to show detail thereof.

The prime mover or engine 12, in this example, is mounted on the sub-frame 5 by conventional means such that the crankshaft (not shown) is parallel to the main frame side members 28. A right hand drive unit 110 (FIG. 2) is secured to a rear portion 112 of the engine 12 and operably communicates therewith. Extending transversely out of both sides of the right hand drive unit and carried in housings 113 is a drive shaft 114 having mounted thereon at opposed free ends thereof drive pulleys 118. An hydraulic pump 130 is positioned rearwardly of the right hand drive unit and is driven thereby.

The drive shaft 114 is journaled in bearing blocks 132 which are mounted on mounting members 134 to the sub-frame rear side members 86.

An idler sheave 136 is mounted on mounting plates 137 which are selectively positioned longitudinally on sub-frame side members 86.

The cutter head 14 is transversely mounted beneath the sub-frame and is supported thereon by bearings 139 which are supported on supports 138. The cutter head 14 is of conventional design, comprising in this preferred example a plurality of laterally spaced, parallel, vertically oriented discs having diamond bits impregnated therein and adapted to plane a road surface. Pulleys 140 are positioned on both ends of the cutter head 14 and are coaxial therewith.

The engine 12 provides the rotational impetus for the cutter head 14 through a plurality of drive belts 141 which are placed over the drive pulleys 118, the idler sheaves 136 and the cutter head pulleys 140.

Two auxiliary outrigger wheels 22 are attached to the sub-frame rear side members 86 and are positioned laterally outwardly and forwardly of the cutter head 14. Each outrigger wheel 22 is rotatably mounted in a vertically oriented clevis 142 supported on a block 143. The block 143 has extending vertically upwardly therefrom, a threaded rod 144 with a turning head 145. The rod 144 is rotatable with respect to block 143 and is threadedly engaged in a mounting bracket 146 which is securely attached to outer vertical surfaces 147 of rear sub-frame side members 86. The threaded rod 144 is operably received in a threaded bore 148 which is situated in a topmost horizontal surface 150 of the mounting bracket 146. The block 143 is telescopically received in a channel 152 defined by side wall members 153 of the mounting bracket 146.

Each pair of depth control wheels 18 is positioned in spaced apart tandem relationship wherein the wheels 18 are rotatably mounted on opposite ends 154 and 155 of a respective depth control wheel mounting member 156. The mounting members 156 are pivotally attached to the pivot beams 20 on coaxially aligned pivot pins 158 that are positioned midway between the two depth control wheels 18.

The pivot beams 20 are pivotally attached at a front end thereof 160 to and received within spaced apart pairs of L-shaped mounting brackets 162. The mounting brackets 162 are laterally spaced such that the depth of control wheels ride in a cut or treated surface of the roadway made by the cutter head 14. The mounting brackets 162 are securely attached to a rear vertical surface 164 of a rear sub-frame cross-member 166. Apertures 168 in pivot beams 20 are aligned with transversely coaxially aligned apertures 172 in a free end 174 of the mounting brackets 162 and receive therein retaining pins 176, thereby allowing the pivot beams to pivot relative the the sub-frame 5.

A vertically oriented adjustment member such as a threaded depth control rod 182 is positioned adjacent a rear portion 184 of both pivot beams 20. The rods 182 are connected to the walking beams 20 so as to allow pivotal movement about a transverse horizontal axis defined by pivot pin 186, which is attached to one end of the threaded rod 182, and is journaled in walking beam side frame members 187.

The rod 182 is received in vertical apertures (not shown) formed in a sub-frame guide 183, which guide extends rearwardly from the sub-frame rear transverse frame member 90. Lock nuts 188 and 190 are threaded on the rod 182 with nut 188 being positioned below the sub-frame and lock nut 190 being positioned above the sub-frame.

The sub-frame guides 183 contain a generally vertical, transversely oriented flat plate 210. Cam followers 212 are rotatably positioned laterally outwardly on plate 210 such that the followers 212 extend laterally beyond an outside surface 216 of the plate 210. The cam followers 212 rest adjacent an inside surface 217 of the main frame medial portion vertical section 31 and prohibit the sub-frame 5 from lateral movement with respect thereto.

Tabs 196 extend upwardly from cross-member 166 and receive therearound a clevis 198 which is attached to a plunger 200 of the vertical cylinder 24. The clevis is pivotally connected to tabs 196 by insertion of a retaining pin 202 through transversely coaxially aligned apertures 204 in tab 196 and apertures 206 in clevis 198.

As best shown in FIGS. 1(*b*) and 7, the front wheel means comprises two wheels 218 and 220 positioned in tandem relationship and supported on vertically oriented L-shaped front wheel mounting members 224 which are rotatably secured about a vertical axis on a T-member 226. Axles 228 extend horizontally and generally transversely from a lower portion of member 224 and receive, rotatably thereon, the wheels 218 and 220. Horizontal steering arms 230 extend generally transversely from the top of member 224. A two-plunger, bidirectional ram arrangement 238, operated through hydraulic lines 239, is positioned atop the T-member 226. Plungers 240 and 242 extend forwardly and rearwardly from a main body 244. The plungers 240 and 242 are connected at their free end to steering arms 230 and are adapted to function opposingly such that when plunger 242 is extended plunger 240 is retracted thereby assuring that both wheels 240 and 242 turn simultaneously in the same direction.

The T-member 226 is pivotally attached by means of a transverse horizontal pivot pin 248 to vertical plate members 250 which extend downwardly from main frame side members 28. Hydraulic motors (not shown) are integrated within the front wheel hubs 254 and are fed through hydraulic lines 256 by hydraulic pump 130.

The rear wheel system comprises two pairs of wheels 260, each pair being mounted in tandem relationship on pivoted support beams 262 which are mounted on the main frame rear portion 27. The wheels include an outer tire section 264 and a hub 266 which, like the front wheels 218 and 220, house an hydraulic motor (not shown) which is driven by the engine 12 through pump 130. A seat 270 is provided for a driver along with a steering wheel 272 and a control panel 274 which houses and displays operating controls and instruments.

The planer 1 is usually transported to a job on a suitable flatbed trailer (not shown). For self-propelled transportation to the work site, the sub-frame 5 is lifted by activation of vertical cylinders 25, thereby removing the cutter head 14 from contact with the surface.

Aside from cutting bumps to level the surface the planer 1 is also utilized to provide a texture to the total road surface. In order to provide an appropriate texture, from 0.030 inches to 0.080 inches of the road surface normally must be ground, or planed away.

The initial cut, which is made without the utilization of a prior cut as a reference, is preferably made on a selected flat surface. Since there is no reference plane available while making the initial cut, the adjustment of the depth control wheels 18 to achieve a proper depth of cut is by trial and error.

The initial placement of the depth control wheel 18 may be determined, for example, by lowering the sub-frame such that the cutter head and depth control wheels are resting in contact with the road surface. The pivot beams are then locked in position. Because of deformation in the sub-frame under load and other factors, it is probable that some of the roadway surface will be cut with the depth control wheels at this setting. A sample cut is made with the cut depth observed relative to an adjacent uncut surface. If the depth of cut is not acceptable, appropriate manipulation of the lock nuts and further trials provide the desired depth of cut for the particular surface involved.

After the depth control wheels are adjusted and locked in place the depth of cut is the depth the cylindrical surface 281 of the cutter head 14 extends below the uncut roadway surface, which will vary according to the condition of the original surface.

The depth of cut made by the planer 1 will remain constant until the cutter head 14 shows appreciable wear which in effect, will materially reduce the diameter of the cutter head and change the vertical distance between the cylindrical cutting surface and the depth control wheels. When this occurs, the depth of cut is readjusted by the rods 182.

As the planer travels along the roadway it will confront various vertical deviations in the surface, such as bumps and depressions. This presents two problems, the first being that of assuring the cutter head is not substantially moved vertically by the travel of the front wheels over the deviations, which would alter the depth of cut. The second problem concerns the planer being capable of removing only a given volume of roadway per unit time, and the encountering of upward deviations tends to increase the volume of roadway cut if the forward speed is constant. This could result in the cutter head being forced to rise which would result in a cut surface which is not level.

The effect of bumps and depressions on vertical movement of the cutter head is minimized by the use of the front pivoted sub-frame. As the front wheels encounter a bump the front end of the main frame is elevated a certain amount, pivoting the main frame 3 about the rear wheels 260. The front of the sub-frame at the pivot pin 100 is raised to a lesser extent, equal to a proportion of the front wheel vertical deviation, which proportion is the fraction consisting of the length from the pivot pin 100 to the rear wheels divided by the total wheel base of the planer.

When the front of the sub-frame is elevated, the sub-frame pivots about the depth control wheels 18. The cutter necessarily is elevated a proportion of the amount the pivot pin 100 is elevated. This proportion is equal to the fraction consisting of the distance between the cutter head 14 and the pins 158 about which the wheel support member 156 pivots, divided by the distance between the pivot pin 100 and the pivot pin 158. Since the first distance is small compared to the second it is seen that the cutter head will be elevated only a small percentage of the amount which the pivot pin 100 is elevated, which amount is also less than the amount the front wheels are elevated when encountering a bump.

To alleviate the problem of having the cutter head rise when encountering bumps, pressure in the hydraulic cylinders 24 may have to be increased. Increasing the pressure in cylinders 24 functions to transfer an increasing portion of the weight of the main frame to the cutter head. The pressure needed is dependent on the hardness of the surface being cut, the type of cutter head, etc.

The operator can often detect the need for increasing the pressure in the cylinders by watching the depth control wheels 18. The wheels 18 are in tangential contact with a horizontal plane defined by the line of the bottom most cylindrical surface of the cutter head 14 and the depth control wheels 18. When the cutter head 14 rises the depth control wheels 18 must also rise, and when one or more lose contact with the surface, it will stop turning. This the operator can observe easily.

To alleviate this problem the operator must transfer more of the weight of the planer 1 to the cutter head 14 by increasing the downward pressure supplied by the vertical cylinders 24. If the pressure exerted by the cylinders 24 is already at a maximum, with the maximum pressure being that pressure which would by just short of the pressure required to lift the rear wheels off the ground, the forward speed of the planer must be reduced. It is noted that there is no adverse effect associated with applying more downward pressure than needed by the vertical cylinders 24 provided the pressure is less than the maximum. The line on the cutter cylindrical surface 281 which is in contact with the roadway and depth control wheels 18 define a given plane which is the treated roadway surface 290. Added pressure from the cylinders 24 will not lower the cutter head below this plane (other than due to minor deflection of parts under load) because of the placement of the depth control wheels on the sub-frame and the locking of same relative to the sub-frame prohibits the cutter head from increasing the depth of cut.

It is further noted that the longitudinal position of the point of application on the sub-frame of pressure exerted by the vertical cylinders 24 is very near the point where the cutter head operably engages the road surface, but forwardly therefrom a short distance. The deformation in the sub-frame produced by application of pressure by the vertical cylinders will be such that the sub-frame member 86 upon which the cutter head is mounted will pivot downwardly about the depth control wheels 18 and therefore the cutter head will extend further into the road surface increasing the depth of cut. This result of deformation in the sub-frame members 86 therefore aids in alleviating the problem of cutter head use.

After a desired length of cut is made the sub-frame 5 is lifted to raise the cutter head 14 from contact with the road surface 280. The positioning of the depth control wheels 18 relative to the sub-frame 5 is not altered if the cut has been satisfactory.

Figure 11:
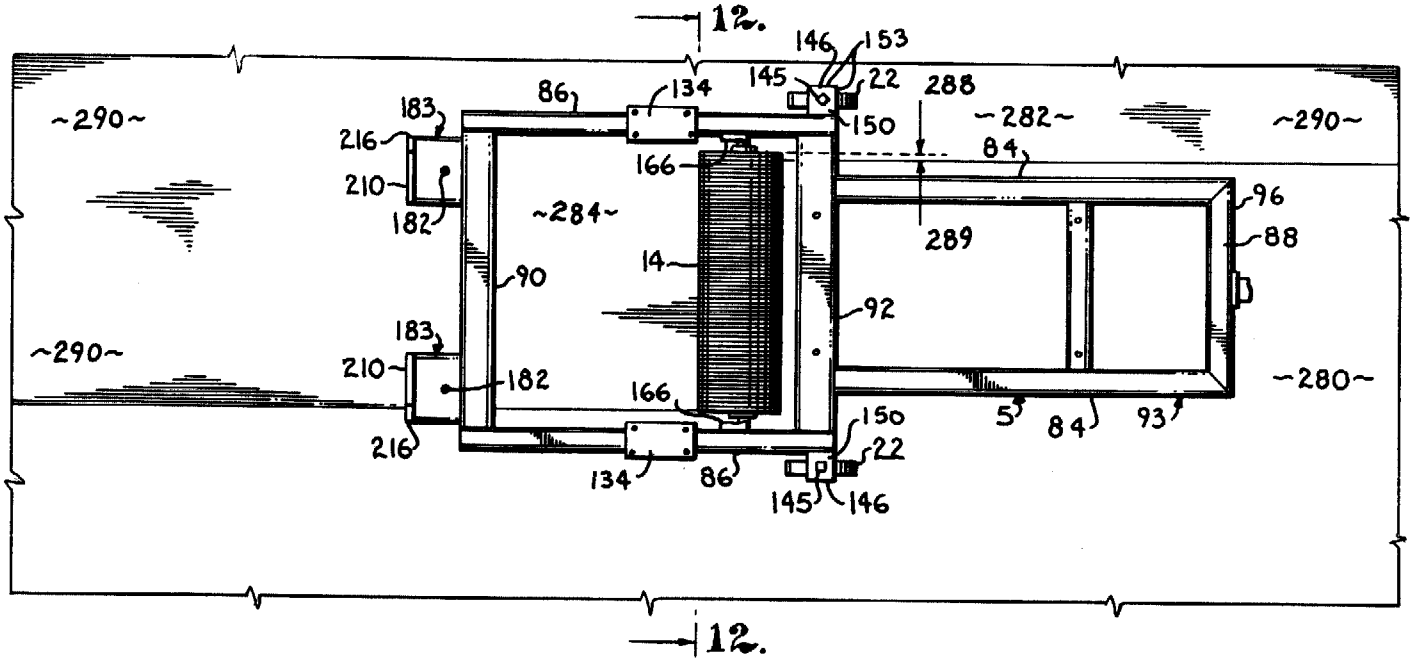
Figure 12:
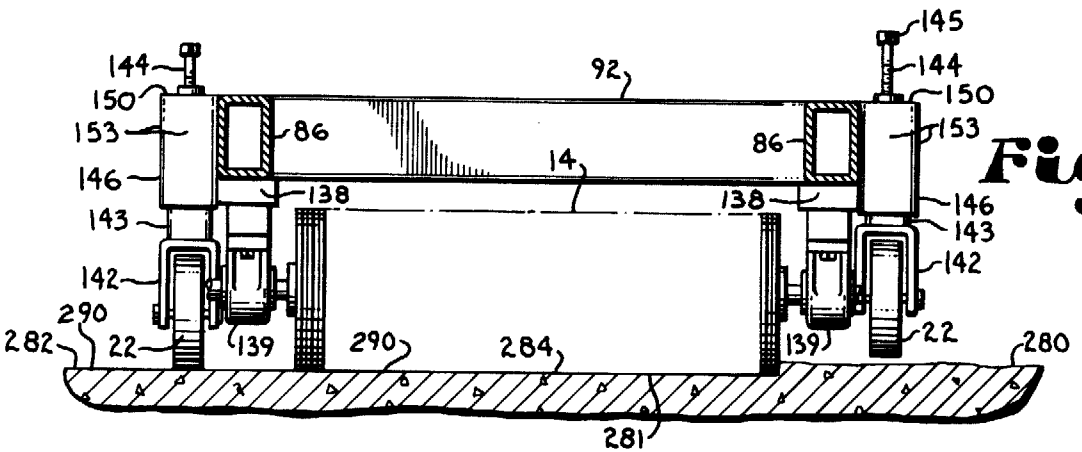
FIG. 12 is a cross-sectional view of the sub-frame taken on lines 12—12 in FIG. 11.

In preparation for making a subsequent cut or swath 284, the planer 1 is positioned adjacent a prior cut 282 such that the end of the cutter head 14, which is adjacent the prior cut 282, overlaps the prior cut 282 a small amount as shown in FIG. 11, between arrows 288 and 290.

In making the subsequent cut 284, the sub-frame 5, preferably, is lowered so as to place the cutter head and depth control wheels 18 into contact with the roadway surface 280. The outrigger wheel 22 which is adjacent the previous cut is lowered into contact with the surface of the prior cut 282. The depth control wheel 18 which is adjacent the prior cut 282 is raised out of contact with the road surface. A sample cut is made. Appropriate adjustments may be made to the positioning of the opposing depth control wheels 18 and outrigger wheel 22 relative to the sub-frame 5 to achieve the desired feathering. The wheels 18 which are adjacent the prior cut will function to prohibit the cutter head from cutting to a greater depth of cut than desired should the outrigger wheel 22 enter an unaffected depression in the prior cut 282.

As in making the initial cut the operator can view the depth control wheels which are in contact with the roadway. He may also observe the outrigger wheel which is in contact with the prior cut surface to easily determine if the cutter head is rising up. If so, additional pressure may be added by the cylinders 24 or the forward speed may be reduced, thereby insuring a proper depth of cut with desired feathering.

When desired, the cutter head 14 may be appropriately slightly tilted about a longitudinal horizontal axis. The hydraulic cylinders 24 operate independently of each other; therefore, after readjusting the control wheels or outrigger wheels, the tilting may be accomplished with little difficulty.

In making a cut the cutter head blades tend to become very hot and must be cooled to maximize their useable life. Also, disposal of the grit produced by the planing operation is required. A cutter head cooling and grit disposal system is provided which is powered by the auxiliary engine (not shown) which is mounted on the main frame rear portion 27.

Water is supplied to the planar by an appropriate tank vehicle (not shown) through a quick release coupling 301. The water is fed through ducts 302 to a vacuum shroud 306 which is positioned around the cutter head. The water is then sprayed on the cutter head for cooling. As a result a water and grit slurry is formed. The auxiliary engine (not shown) operably engages a vacuum pump 308 which provides the suction needed to withdraw the slurry from around the cutter head.

The slurry is withdrawn from the shroud 306 through ducts 304 and is deposited into a cyclo-separator 310. The slurry is then disposed of in an appropriate manner.

It is envisioned that the cutter head 14 may be replaced with a grooving head (not shown) of the type well known in the prior art which is adapted to cut laterally spaced, parallel anti-skid grooves in the roadway. The function of the depth control wheels 18 will be somewhat similar, but the outrigger wheels 22 will have no function when using a grooving head.

The difference regarding the depth control wheels lies in the fact that they will not ride in the grooves themselves but, rather on the roadway surface.

It is to be understood that while certain forms of the present invention have been illustrated and described, it is not to be limited to the specific forms or arrangement of parts herein described and shown, except insofar as such limitations are included in the following claims.

What is claimed and desired to secure by Letters Patent is:

1. An elongated roadway surfacing machine comprising:

(a) a rigid main frame having front and rear ground engaging support wheels, means driving at least certain of said support wheels for moving said main frame forwardly along a surface;

(b) a sub-frame mounted on said main frame between said front and rear wheels and adapted to move vertically with respect to said main frame;

(c) a cutter head rotatably mounted on said sub-frame transversely of said main frame;

(d) depth of cut control means vertically adjustably mounted on said sub-frame rearwardly of said cutter head and engaging the cut behind said cutter head for controlling the depth of cutter head displacement into said surface;

(e) weight transfer means connected between said main frame and said sub-frame forwardly of said depth of cut control means; and (f) a prime mover operably engaged with said cutter head to provide rotational motion thereto during forward motion of said main frame.

2. A machine as set forth in claim 1 wherein:

(a) said sub-frame is pivotally connected to said main frame.

3. A machine as set forth in claim 1 wherein:

(a) said prime mover is mounted on said sub-frame.

4. A machine as set forth in claim 3 wherein:

(a) said prime mover is mounted on said sub-frame between said cutter head and the point of pivotal sub-frame connection with said main frame.

5. A machine as set forth in claim 1 wherein:

(a) said main frame includes a raised medial portion;

(b) said sub-frame comprises a front portion and a rear portion;

(c) said sub-frame front portion is pivotally mounted on said main frame; and (d) said sub-frame rear portion carries said cutter head and is located within said main frame medial portion.

6. A machine as set forth in claim 1 wherein:

(a) said depth of cut control means includes wheels which ride in said cut and support said sub-frame against downward deflection.

7. A machine as set forth in claim 1 wherein said weight transfer means comprises:

(a) ram means connected between said main frame and said sub-frame, said ram means selectively transferring the weight of said main frame to said cutter head for snubbing said cutter head into said cut.

8. A roadway surfacing machine comprising:

(a) a rigid main frame having a front end, a medial portion and a rear end;

(b) front wheel means mounted on said main frame near said main frame front end;

(c) rear wheel means mounted on said main frame near said main frame rear end;

(d) a rigid sub-frame having a rear portion located substantially in said main frame medial portion and a front portion, said sub-frame front portion being pivotally mounted on said main frame providing vertical pivotal movement of said sub-frame rear portion relative to said main frame medial portion;

(e) a cylindrical abrasive cutter head adapted to treat a roadway surface so as to modify said surface; said cutter head being rotatably mounted transversely on said sub-frame rear portion;

(f) prime mover means mounted on said sub-frame and operably engaged with said cutter head to provide rotational motion thereto;

(g) depth of cut control means mounted on said sub-frame for controlling the depth of cutter head displacement into said surface, said depth of cut control means engaging said surface on a treated portion thereof rearwardly of said cutter head and supporting said sub-frame against downwardly pivoting relative to said main frame;

(h) adjusting means connected between said sub-frame and depth of cut control means for selectively varying the vertical displacement therebetween, thereby controlling the depth of cut; and (i) ram means connected between said main frame and said sub-frame forwardly of said depth of cut control means for selectively transferring the weight of said main frame to said cutter head for snubbing said cutter head onto the roadway.

9. A machine as set forth in claim 8 wherein:

(a) said depth of cut control means includes wheels rotatably engaging said treated surface and providing a reference for accurately controlling the depth of cut.

10. A machine as set forth in claim 8 wherein said depth of cut control means includes:

(a) two pivot beams pivotally mounted near a first end thereof to the sub-frame and communicating at a point spaced apart from said first end with said adjusting means.

11. A machine as set forth in claim 8 wherein:

(a) one of said wheels depend from each of said pivot beams at a point spaced apart from said pivot beam first end; and (b) said depth control wheels are adapted to roll on said surface.

12. A machine as set forth in claim 8 wherein said depth of cut control means includes:

(a) two pairs of depth control wheels and a pair of longitudinally positioned wheel support members, each pair of said depth control wheels being rotatably mounted in tandem relationship on opposite ends of said wheel support members.

13. A machine as set forth in claim 8 wherein said ram means comprises:

(a) vertically oriented hydraulic cylinders located laterally outwardly of said main frame and wherein;

(b) said hydraulic cylinders are pivotally connected at a first end thereof to the main frame at said medial portion thereof, and (c) said hydraulic cylinders are pivotally attached at a second end thereof to said sub-frame.

14. A machine as set forth in claim 13 wherein:

(a) said hydraulic cylinder second end is mounted on said sub-frame adjacent said cutter head.

15. A machine as set forth in claim 8 wherein:

(a) said adjusting means is operably positioned between said sub-frame and each of said pivot beams at a point spaced apart from said pivot beam first end.

16. A machine as in claim 15 wherein:

(a) said adjusting means is positioned in a rear portion of said pivot beams.

17. A machine as set out in claim 15 wherein said adjusting means comprises:

(a) a threaded depth control rod having a top and bottom portion; said rod bottom portion being mounted on said pivot beam and extending upwardly therefrom;

(b) rod receiving apertures formed in said sub-frame to allow the movement therethrough of said rod top portion; and (c) lock nuts threadably received on said rod and adapted to selectively lock said pivot beams at a vertical position spaced apart from said sub-frame.

18. A roadway surfacing machine comprising:

(a) a rigid main frame having front and rear wheels mounted thereon and supporting said main frame on a surface for independent movement therealong;

(b) drive means associated with certain of said front and rear wheels whereby said main frame is self-propelled;

(c) a sub-frame movably mounted on said main frame between said front and rear wheels allowing vertical movement of said sub-frame relative to said main frame;

(d) a cylindrical abrasive cutter head rotatably mounted on said sub-frame;

(e) a prime mover operably engaged with said cutter head to provide rotational motion thereto;

(f) depth of cut control means mounted on said sub-frame in a position to engage the cut made by said cutter head; and (g) weight transfer means connected between said main frame and sub-frame at a point transferring weight from said main frame to said sub-frame forwardly of the engagement of said depth of cut control means on said cut.

* * * * *